US005314182A

United States Patent [19]

Derr

[11] Patent Number: 5,314,182

[45] Date of Patent: May 24, 1994

[54] FISHING BOARD GAME AND METHOD

[76] Inventor: Daniel D. Derr, P.O. Box 235, Houston, Ak. 99694

[21] Appl. No.: 42,778

[22] Filed: Apr. 2, 1993

[51] Int. Cl.[5] ..... A63F 3/00

[52] U.S. Cl. ..... 273/140; 273/249; 273/244

[58] Field of Search ..... 273/140, 241, 256, 239, 273/244, 247

[56] References Cited

U.S. PATENT DOCUMENTS 484,950 10/1892 Dungey ..... 273/140

3,545,750 12/1970 Stachuik ..... 273/140

OTHER PUBLICATIONS

"Fisherman's Luck" advertisement, Playthings magazine, Aug., 1958, vol. No. 56, No. 8, p. 26.

*Primary Examiner*—Benjamin H. Layno

[57] ABSTRACT

A two level board game with opaque sides that attach the top and bottom levels, while also containing and concealing the board games components that are in the area between the top and bottom levels, is disclosed. The top level of this board game has at least one hole, with a plurality of holes being the preferred method. Material is placed across the underside of the top level holes in a manner that allows entry to the bottom level yet prevents players from seeing the bottom level. The bottom level has at least one depression with a plurality of different size depressions located under and down away from the top level holes being the preferred method. These bottom level depressions collect game components and direct them toward there centers. The object of the game is to use the board games hooking devise to reach through the top level holes and try to hook the concealed game components that may have collected in the depression the player is reaching in. This game is designed to simulate fishing.

11 Claims, 3 Drawing Sheets

FISHING BOARD GAME AND METHOD

SUMMARY

This invention is a board game designed to simulate a sports fishing experience.

Players move around the game course according to the amount shown on the dice they roll, if they land on a space that allows fishing they put the hooking devise through one top level access hole and try to hook game components located in the concealed cavity between the board games top and bottom levels.

This two level board game conceals the bottom board level so players can not see where the game components are located. This is accomplished by attaching the top and bottom levels with opaque sides.

The design of the depressions located on the bottom board level cause the game components to collect only in the depressions. The tops of the depressions are approximately half the distance between the top and bottom board levels, this allows players to shake the board game to change positions of the game components located in this concealed cavity, thereby making it impossible for the players to know which depressions game components have collected in.

DETAILED DESCRIPTION

Figure 1:
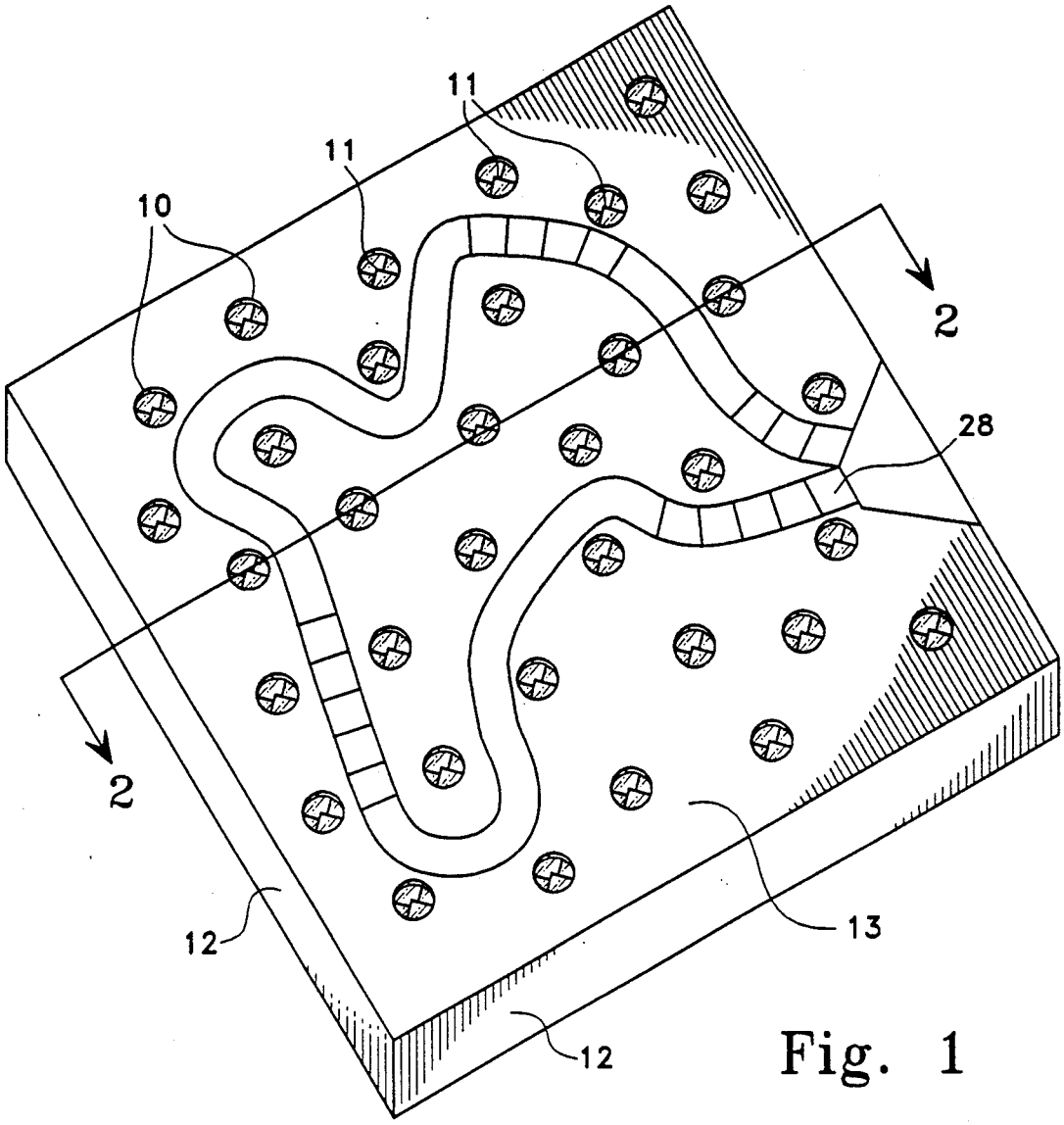
FIG. 1 Is a isometric view of the board games top level playing surface and two sides.
Figure 2:
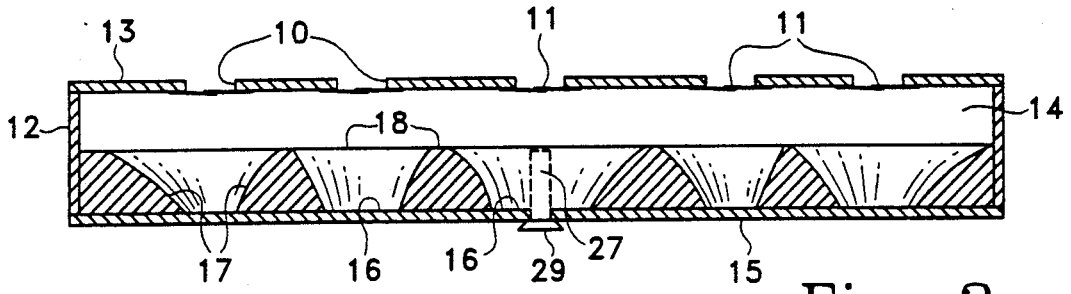
FIG. 2 Is a cross sectional view of the board game taken along line 2—2.
Figure 6:
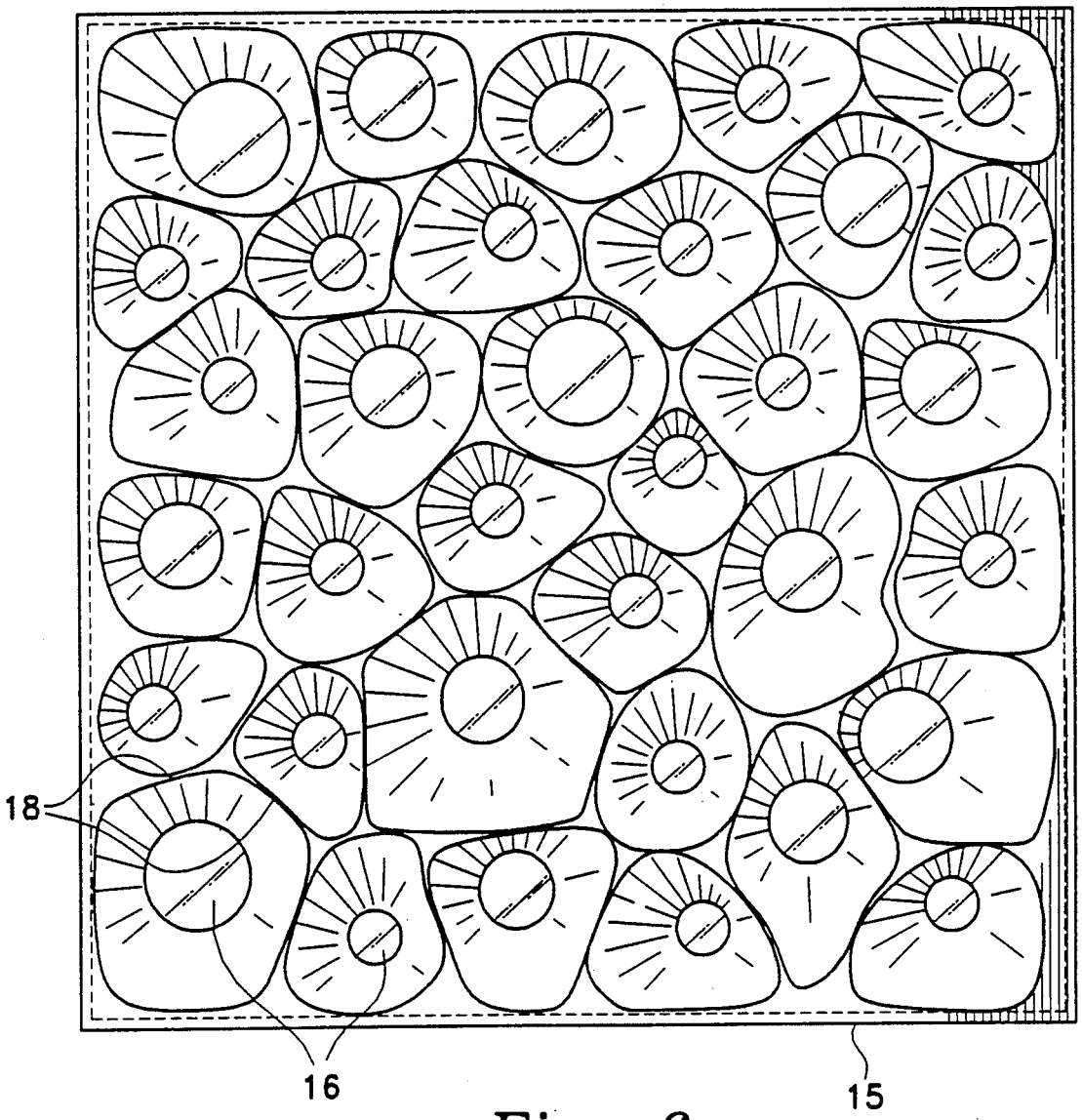
FIG. 6 Is a top view of the bottom level with contour lines showing ridges and depressions.

Referring to the drawing, wherein like references characters refer to like parts, a two level board game according to the invention is shown in FIGS. 1 2 and 6, this two level board game basically includes a top level 13 and a bottom level 15 approximately two inch sides 12 attach the top level 13 anf bottom level 15, the sides also conceals the cavity 14 located between the top 13 and bottom 15 levels.

The board games top level 13 contains at least one hole, 10 although the best way for carrying out the invention is a plurality of holes 10 that provide a means of entry to access the bottom level 15 and the cavity 14 between top level 13 and bottom level 15.

On the bottom side of the top level 13, elastic material 11 covers the holes 10 in a manner that allows the hooking devise (FIG. 3) to reach the bottom level 15 yet also prevents the players from seeing the bottom level 15. The preferred method to accomplish this although not mandatory is to use four pieces of triangular shaped, elastic type material. Piece 25 overlaps piece 23, piece 24 and piece 26, with piece 23 overlapping piece 24 and piece 26.(See 23, 24, 25 and 26)

The bottom level 15 basically consists of at least one depression, although a plurality of different diameter and shaped depressions 16 that are basically circular around their perimeter is the best way for carrying out the invention. The centers of these depressions 16 are located basically below the centers of the holes 10 that go through the top level 13. These depressions 16 angle 17 up from the bottom, makeing there tops wider than there bottoms. This makes the ridges 18 of the depressions slope toward there centers. Some depressions 16 angle up towards one another, when the depressions 16 upward sloping angles 17 meet, ridges 18 are formed. These ridges 18 and the downward angle 17 of the depressions 16 cause the board games components 30 to slide towards the center of the depressions 16, there by providing a holding and gathering means. These depressions 16 and ridge 18 formations are preferred method for carrying out the invention but are not mandatory, any other suitable method will work, even a flat bottom level. The preferred method for carrying out this invention is to use a two level board but is not mandatory, for example a three or four level board could accomplish the same objective.

The ridge 18 height is approximately one half the overall distance between the bottom level 15 and the bottom of the top level 13. This leaves approximately one inch of open space 14 between the tops of the ridges 18 and the bottom of the top level 13. This cavity 14 allows the game componets 30 concealed and contained between the top level 13 and bottom level 15 to be scattered to any of the depressions 1 6 when the board game is shook by the players.

Figure 3:
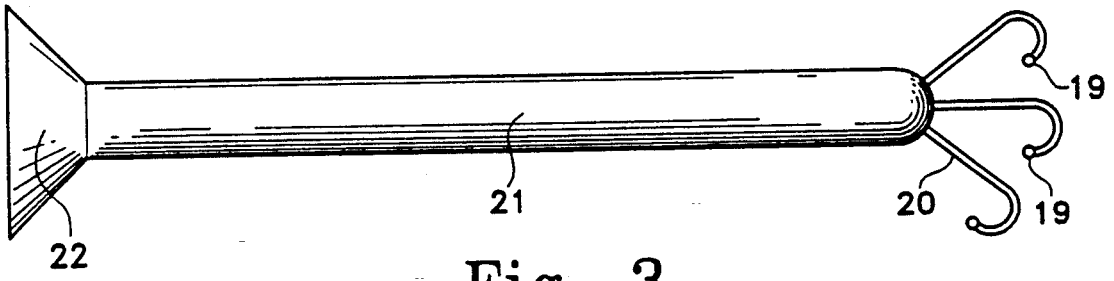
FIG. 3 Is a plain view of the hooking devise.
Figure 4:
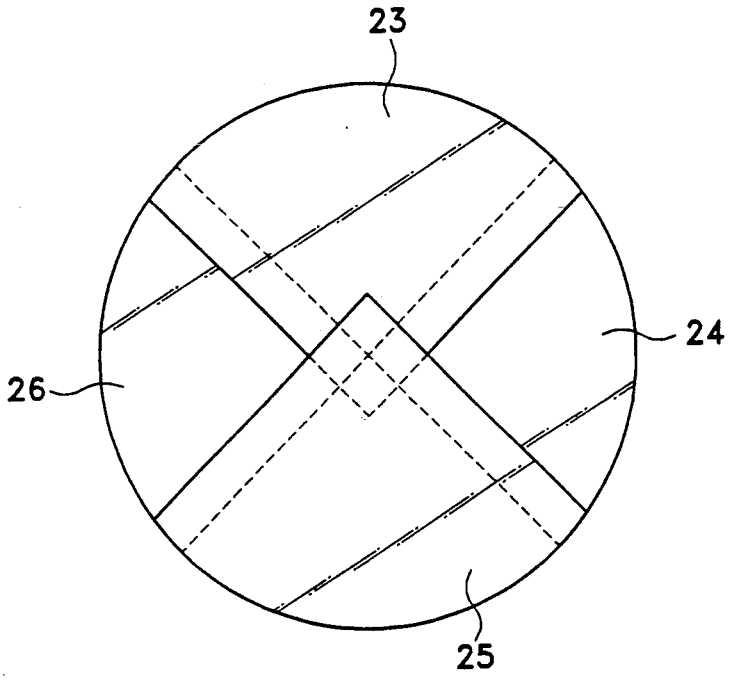
FIG. 4 Is a exploded view of the access hole cover material.
Figure 5:
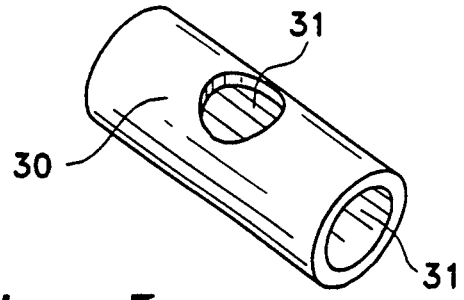
FIG. 5 Is a exploded view of one game component that is located in the board games concealed area.

Board game components 30 have at least one hole 31 through the game components body 30. Some game components 30 have two or three holes 31 through there body 30, there by making them easier to hook with the hooking devise (FIG. 3). Game components 30 with multiple holes 31 are worth less point value. For example, game components 30 with one hole 31 are worth five points, game components 30 with two holes 31 are worth four points and game components 30 with three holes 31 are worth three points. Several scores of game components 30 are placed through top level 13 holes 10. The number of game components 30 placed through the top board holes 10 can vary according to player or players desire. The game components 30 are then out of sight and contained. Game components 30 are scattered randomly when the board game (FIG. 1) is shook, there by making it impossible for the players to know where the game components 30 are located. The game components 30 represent fish and-hooking game components 30 with hooking devise (FIG. 3) is the object of the board game.

The hooking devise (FIG. 3) basically consist of a round body 21, flat expanded handle 22 and fish hook shaped end 20 that has a small expansion 19 at or near the end. This hooking devise (FIG. 3) could have one or more fish hook 20 shaped ends and is the preferred method but not mandatory, any other suitable method will work.

The board game's top level 13 has a course 28 that players move along according to the number on the dice they roll. When the player rolling the dice lands on a spot that permits them the right to fish, that player then inserts the hooking devise (FIG. 3) through the board games top level 13 hole 10 and down through material 11 into the depression 16. The hooking devise (FIG. 3) is then moved around in the depression 16 attempting to hook the game components 30 that might have collected in the depression 16, without being able to see the game components 30 because the material 11 obstructs the players view. The external shape of the board game does not have to be square ( FIGS. 1 and 6

) to accomplish the games objective. Any shape will work, for example the board can be circular or triangular.

A optional feature is a column 27 located in the center of the bottom level 15, this column 27 has a rubber base plate 29 that holds the column 27 stationary so the board game can rotate 360 degrees so the players have better access to the top level 13 holes 10.

Materials used for construction of said board game, (FIG. 1) game components 30 and hooking devise (FIG. 3) should be plastic, this is the preferred material but not mandatory, any suitable material will work.

I claim:

1. A board game comprising:

a) an opaque top board, said top board having at least one hole formed therein;

b) a bottom board;

c) opaque side wall means to connect said top board and bottom board such that a hollow cavity is formed therebetween and further such that the opaque side wall means act to seal said cavity;

d) a plurality of game pieces, said game pieces being sized to fit through said hole in said top board and further having at least one hole placed therein;

e) hooking device having long thin handles and at least one hooked end formed therein to engage said hole in said game pieces;

f) an opaque cover means fixed placed over said hole in said top board such that said cover means prevents visual access to said bottom board, said cover means also having a elastic members that opens to permit penetration of said hooking device through said hole in said top board when the hooking device is pushed through said cover means, and closes when said hooking devise is removed;

g) a holding means, being fixedly attached to said bottom board to hold said game pieces in a fixed location corresponding to the hole positions in said top board; and h) a gathering means to move said game pieces to said holding means.

2. The board game of claim 1 further comprising:

a) a plurality of additional holes formed in said top board;

b) cover means to cover said additional holes;

c) additional holding means on said bottom board to correspond to said additional holes in said top board; and d) additional gathering means on said bottom board to correspond to said holding means in said bottom board.

3. The board game of claim 2 wherein said gathering means comprise: a plurality of formed contour surfaces that angle downwardly and in the direction of said holding means such that game pieces moving over the gathering means are forced into said holding means.

4. The board game of claim 3 wherein said gathering means distribute the same game pieces in a random pattern.

5. The board game of claim 1 wherein said cover means comprise a plurality of elastic, opaque material fixedly attached to said top board such that they overlap to prevent visual access.

6. A board game comprising:

a) an opaque top board, said top board having a plurality of holes formed therein;

b) a bottom board;

c) opaque side wall means to connect said top board and bottom board such that a hollow cavity is formed therebetween and further such that the opaque side wall means act to seal said cavity;

d) a plurality of game pieces said game pieces being sized to fit through said hole in said top board and further having a plurality of holes placed therein;

e) hooking devices having long thin handles and a plurality of hooked ends formed therein to engage said holes in said game pieces;

f) a opaque cover means fixedly placed over said holes in said top board such that said cover means prevents visual access to said bottom board, said cover means also having elastic members that open to permit penetration of said hooking device through any one of said holes in said top board when the hooking devise is pushed through said cover means, and closes when said hooking devise is removed;

g) a holding means, being fixedly attached to said bottom board to hold said game pieces in a fixed location corresponding to the hole positions in said top board; and h) a plurality of gathering means with contoured surfaces that angle downwardly and in the direction of said holding means such that game components moving over said gathering means are forced into said holding means.

7. The board game of claim 6 wherein said gathering means comprise: a plurality of formed contour surfaces that angle downwardly and in the direction of said holding means such that game pieces moving over the gathering means are forced into said holding means.

8. The board game of claim 7 wherein said gathering means distribute the said game components in a random pattern.

9. The board game of claim 6 wherein said cover means comprise a plurality of elastic, opaque material fixedly attached to said top board such that they overlap said holes to prevent visual access.

10. The board game of claim 5 having a plurality of levels.

11. The method of playing a board game having top board having a plurality of holes an opaque formed therein; a bottom board; opaque side wall means to connect said top board and bottom board such that a hollow cavity is formed therebetween and further such that said side wall means act to seal said cavity; a plurality of game pieces, said game components being sized to fit through said holes in said top board and further having at least one hole placed therein; a hooking device having a long thin handle and at least one hooked end formed therein to engage said hole in said game pieces; opaque cover means fixedly placed over said holes in said top board such that cover means prevent visual access to said bottom board, said cover means also having a resilient member that opens to permit penetration through a hole in said top board when the hooking device is pushed through said hover access means and closes when said hooking devise is removed; holding means, being fixedly attached to said bottom board to hold said game component in a fixed location corresponding to the positions of said in said top board; gathering means to move said game piece to said holding means; a game path displayed on said top board having a plurality of segments; and a plurality of player markers used to designate the position of a player on the path comprising the steps of:

a) placing a plurality of game piece through said top holes in said top board;

b) shaking said game board to cause said game piece to be randomly distributed in said holding means;

c) moving a players marker a designated number of segments along said path;

d) placing said hooking device through on of said top board holes and cover means to access the area below the said top board;

e) using said hooking device to attempt to hook game pieces located in the fixed location corresponding to said hole and f) removing said hooking device form said fixed location to determine whether a game piece was hooked.

* * * * *